United States Patent [19]

Weber et al.

[11] 3,972,714

[45] Aug. 3, 1976

[54] METHOD FOR ELECTROSTATIC REPRODUCTION BY CHARGE TRANSFER

[75] Inventors: Guy Weber, Arques La Bataille; Quang Pham Kim, Dieppe, both of France

[73] Assignee: La Cellophane, Paris, France

[22] Filed: Mar. 2, 1973

[21] Appl. No.: 337,744

[30] Foreign Application Priority Data

| | | |
|---|---|---|
| Mar. 3, 1972 | France | 72.07402 |
| Nov. 27, 1972 | France | 72.42003 |

[52] U.S. Cl. ..... 96/1 TE; 355/3 R

[51] Int. Cl.[2] ..... G03G 13/22

[58] Field of Search ..... 96/1 R, 1 TE, 1 C, 1.3, 96/1.4; 355/3

[56] References Cited

UNITED STATES PATENTS

| | | | |
|---|---|---|---|
| 2,833,648 | 5/1958 | Walkup | 96/1 R |
| 3,464,818 | 11/1969 | Waly | 96/1 R |
| 3,666,458 | 5/1972 | Arneth et al. | 96/1 R |
| 3,672,930 | 6/1972 | Trachtenberg | 96/1 R |

FOREIGN PATENTS OR APPLICATIONS

| | | |
|---|---|---|
| 2,093,603 | 5/1970 | France |

*Primary Examiner*—David Klein
*Assistant Examiner*—John L. Goodrow
*Attorney, Agent, or Firm*—Sherman & Shalloway

[57] ABSTRACT

Method and apparatus for electrostatic reproduction of originals by transfer of a latent charge image from an intermediate surface to an uncharged insulating surface by moving the intermediate and insulating surfaces to a virtual contact point and producing an external electric field between a pair of electrodes at the virtual contact point to ionize the space between the intermediate and insulating surfaces to transfer the charge image progressively therebetween on a line-by-line basis, instantaneously. The apparatus includes a first drum having an insulative dielectric or photoconductive intermediate surface thereon and a second drum moving the insulating surface to a point in immediate tangential proximity to the intermediate surface such that the intermediate and insulating surfaces are moved in respective converging paths toward the point of immediate tangential proximity and in diverging paths away from the point of immediate tangential proximity with the first and second drums forming a pair of electrodes to establish the external field. The external electric field can be produced from a direct current voltage or from an alternating current voltage, the auxiliary field established by either of these sources being added to the field established by the charge image to exceed, for at least a portion of the time during which a point of the charge image is in an ionization zone between the drums, an ionization potential to transfer the charge.

3 Claims, 3 Drawing Figures

METHOD FOR ELECTROSTATIC REPRODUCTION BY CHARGE TRANSFER

BACKGROUND OF THE INVENTION

1. Field of the Invention

The present invention pertains to electrostatic reproduction of documents and, more particularly, to method and apparatus incorporating charge transfer to electrostatically reproduce copies from opaque or transparent originals.

2. Discussion of the Prior Art

There have been basically two techniques commercially utilized for electrophotographic reproduction. In the first method, a latent charge image is formed on a photoconductive surface on the copy sheet itself and the latent image is developed in situ by means of a charged liquid or powder developer or toner. This method of electrophotographic reproduction is relatively expensive due to the fact that each copy sheet must carry a photoconductive layer. In the second method, a latent charge image is formed on an intermediated photoconductive surface, for example a selenium coated drum, and the latent image is developed by applying an electrostatic powder thereto, the developed powder image then being transferred to a copy sheet and fixed. The step of transferring the developed image to the copy sheet, which in principle is less expensive due to the decreased expense of the copy sheet, nonetheless has the disadvantage that the latent image must be developed prior to transfer. Accordingly, the transfer of the developed powder image, of necessity, requires precise, delicate apparatus, careful maintainance and constant cleaning of the photoconductive surface.

Due to the above-mentioned disadvantage in the transfer of powder images, attempts have been made to improve the second method by transferring the latent image formed by the electrostatic charges on the photoconductive surface rather than a developed image. As exemplified by French Pat. No. 1,110,794, one attempt to transfer the electrostatic charge image has included the placing of a dielectric surface above a conductive electrode and disposing a photoconductive layer associated with a transparent conductive support against the dielectric surface. While the photoconductive layer is exposed to a light image, an electric field is applied between the electrode supporting the dielectric surface and the conductive support for the photoconductive layer. This method does not represent true charge transfer in that the photoconductive layer is not previously charged. That is, this method operates by the creation of a charge image directly on the dielectric surface and, thus, constitutes more accurately a process of dielectric writing. In a variation of this method, a transparent electrode can be utilized as a support for the dielectric surface with the latent image being formed by means of the transparent electrode. A major disadvantage of this method of overcoming the problem of charge transfer is that the method is essentially static; that is, the method must be performed while the components thereof are stationary.

A method similar to that described above but which can be applied dynamically is exemplified by French Pat. No. 1,488,489 and uses photoconductors with persisting conductivity by forming zones of differential conductivity through the transparent support for the photoconductive layer. This method is also essentially a method of dielectric writing rather than a transfer process in that the photoconductive layer is not previously charged.

Another method attempting to overcome the problem of transfer of powder images, as exemplified by French Pat. No. 1,413,952, applies a charge image previously formed on a photoconductive surface to a dielectric surface under the effect of high pressure. The charge transfer, which is efficient, is performed under the effect of the field created only by the charges deposited on the photoconductive surface without the necessity of an external electric field and the charge transfer occurs when the resultant of the charge field exceeds the value of an ionizing field. This method, while being dynamic in nature, requires that the photoconductive and dielectric surfaces be intimately contacting one another under high pressure; however, even under the best of conditions, only part of the charge is transferred and the results of the method are not acceptable. Similarly, it has been proposed, for example as shown in French Pat. No. 2,024,150, to use certain photoconductors that accept very high charge levels in an attempt to permit dynamic transfer of latent charge images onto a dielectric surface without requiring excessively high pressure and also without necessitating an external field; however, this method has the disadvantage of requiring a high potential which, in turn, requires expensive apparatus and undue limitations on the user.

Other methods of transferring latent charge images utilize the effect of an external field to transfer the charge onto a previously charged insulating surface from a photoconductor surface, as exemplified by French Pat. No. 1,105,940 wherein a latent image previously formed on a photoconductive surface is transferred to an insulating surface which has previously been uniformly charged. This method utilizes an appropriate external field or an excessively high charge applied to the image to be transferred in order to avoid the requirement of high mechanical pressure; this method, which operates by destruction of charges previously deposited on the insulating surface and not by true charge transfer, yields only mediocre results due to the fact that the insulating surface often contains persistent unwanted charges causing an undesired background in the reproduced copy and, further, this method is, of necessity, of a static nature. Because of the presence of an external field sufficiently strong to destroy all previously deposited charges on the insulating surface, there are parasitic transfers which disturb the light zones in the reproduced image. The above-mentioned disadvantages are also apparent when this method is improved, as suggested by British Pat. No. 855,727, by using a pulsed current to form the electric field between the electrodes.

An attempt to utilize the immediately above described method dynamically, for example as disclosed in French Pat. No. 1,531,688, has utilized an electric field formed of a continuous component and a high frequency component to transfer a latent image formed on the photoconductive surface of a drum to an insulating sheet that has previously been uniformly charged and is supported by a second drum, the two drums rotating tangentially at the same peripheral speed in immediate proximity to each other. This method creates an ionized zone between the two drums, such ionized zone being persistent by the high frequency current and not being instantaneous. An improvement of this method contemplates extending the dimensions of the ionized zone by utilizing a conductive grid; however, such improvement does not eliminate the background that persists in the light zone of reproduction or the familiar parasitic discharges.

SUMMARY OF THE INVENTION

Accordingly, it is an object of the present invention to overcome the above-mentioned disadvantages of the prior art by providing a method and apparatus for electrostatic reproduction representing a radical departure from the above described methods of the prior art.

A general object of the present invention is to transfer a charge image previously formed at an intermediate dielectric or photoconductive surface onto an insulating surface that has not been previously charged by effecting such transfer under an external electric field produced between two electrodes, the field operating when the intermediate surface carrying the charge image to be transferred and the insulating surface come into virtual contact with the transfer being effected progressively, line-by-line, instantaneously.

Another object of the present invention is to dynamically transfer a charge image in an electrophotographic reproduction system by transferring the charge only when the charge bearing surface is moved tangentially into virtual contact with the charge receiving surface; by virtual contact is meant within the immediate vicinity or close proximity of each other.

Between the charge carrying and receiving surfaces in virtual contact, there is a this area space having a thickness dependent upon the surface condition of the materials in virtual contact and it is an additional object of the present invention to provide a process for transferring charges that does not require a high level of electric charges and is effected without any mechanical pressure.

In contrast to the above described methods of the prior art, the basic principle of the present invention is transferring the charge image by creating by means of an external field a zone of ionization having as small an effective area or extent as possible, limited to the zone of virtual contact between the charge carrying and charge receiving surfaces, the value or intensity of the external field added to the value or intensity of the field created by the image charges being only sufficient to transfer the charge in the localized ionization zone.

The present invention has another object in that an ionization zone is defined between a charge carrying surface and a charge receiving surface to specifically limit the area of the charge image capable of being transferred to the charge receiving surface such that only charges forming the latent image to be transferred are destroyed and equivalent charges corresponding to such latent image are received on the charge receiving surface which need not be charged prior to transfer of the image thereto.

Yet, a further object of the present invention is to precisely define an ionization zone for transfer of a charge image from an intermediate surface to an insulating surface such that the image transferred is effected virtually line-by-line and, possibly, point-by-point to thereby increase definition of the transferred latent image.

An additional object of the present invention is to prevent parasitic discharge during transfer of a charge image from an intermediate surface to an insulating surface by transferring the latent image integrally with fine definition without creating a colored background in the light zones of the transferred image and without the appearance of Lichtenberg figures. The background and Lichtenberg figures are avoided in that the method of the present invention artificially creates a local discharge at the desired place similar to a lightning rod drawing lightning.

The present invention has another object in that relatively low level charges of a latent image can be transferred to an insulating surface with as great definition as higher level charges of the latent image.

An additional object of the present invention is to utilize a pair of cylinders having parallel axes of rotation turning at the same peripheral speed, either in the same or opposite directions, to bring an intermediate surface carrying a latent image toward an insulating surface to receive the latent image, the use of such cylinders or drums further having the object of increasing quality of reproduction and maintaining such reproduction quality when transfer speed is greatly increased to permit the method and apparatus of the present invention to provide high rates of operation comparable to offset duplicators.

A further object of the present invention is to effect the transfer of a latent image to an insulating surface utilizing a continuous, level, direct current voltage applied between a pair of electrodes to set up an external field, such voltage being variable depending upon the nature of the charged image to be transferred, the nature of the insulating surface and the design of the apparatus utilized.

Another object of the present invention is to utilize an alternating voltage to create an external field for transferring a latent image to an insulating surface to obviate additional equipment required to provide a direct current voltage and further to facilitate reversal reproduction thereby increasing flexibility of the method and apparatus of the present invention.

The present invention has a further object in the creation of an auxiliary alternating field superposed on the field created by a latent image to be transferred such that the resultant external field becomes sufficient to ionize the space separating the intermediate surface carrying the latent image and the insulating surface for receiving the latent image in a zone where a pair of electrodes are in close proximity. Such object is accomplished without requiring the application of a direct current voltage by controlling the rate of rotation of a pair of cylindrical drums forming the electrodes and supporting the intermediated and insulating surfaces, and the frequency of the alternating current creating the auxiliary field such that the resultant external field will always exceed the level of ionization while a point is in the ionization zone where the two drums are in virtual contact or close proximity.

Generally, the method of the present invention is based on the determination of a critical distance between the homologous points between which charge transfer is to be accomplished and determining a corresponding level of ionization relative thereto such that in associating the rate of movement of an intermediate surface carrying a charge image to be transferred and an insulating surface for receiving the charge image with an alternating auxiliary field having an amplitude less than the ionization level such that the external field resulting from the addition of the charged image field and the auxiliary field always exceeds the ionization threshold during the time in which charge transfer can be accomplished.

If the rate of passage V of the charged image and the insulating surface is such that the transfer can occur during an interval $t$ in the course of which the homologous points are separated by a distance less than a critical ionization distance $d$, the transfer of charges will be reliably effected if $t$ is greater than or equal to the period $T$ of the alternating current producing the auxiliary field, $T$ being the inverse of the alternating current frequency $N$:

$$T = 1/N$$

If $l$ designates the distance traversed by a point of the charged image during time $t$ of possible charge transfer: $l = V \cdot t$, and $t = l/V$such that charge transfer will be accomplished if $$l/V \geqslant T$$

or if $$l/V \geqslant 1/N$$

Generally, the apparatus of the present invention for implementing the method includes a first rotating cylindrical drum constructed of electrical conductive material and coated with a dielectric or photoconductive surface; means for forming an image of charges on the surface of the first drum; a second rotating cylindrical drum constructed of electrical conductive material and disposed to come into virtual, tangential contact with the firt cylindrical drum; means for rotating the two cylindrical drums at the same peripheral speed; a sheet of material, one surface of which at least is insulating or made temporarily insulating, the sheet moving along with the periphery of the second cylindrical drum; means for establishing a difference of potential between the two cylindrical drums; and means for developing and fixing the transferred charged image on the insulating sheet downstream of the point of tangential contact between the first and second cylindrical drums. The apparatus, as described above, can be embodied in a great number of ways depending upon the manner in which the charged image to be transferred is produced as well as upon the nature of the insulating surface and the means for creating the external field for causing transfer of the charged image.

The present invention is generally characterized in a method for electrostatic reproduction of originals including the steps of forming a preliminary charge image corresponding to an original to be reproduced on an intermediate dielectric or photoconductive surface; transferring the charge image from the intermediate surface to an uncharged insulating surface progressively, line-by-line, instantaneously, including continuously moving the intermediate surface and the insulating surface passed a virtual contact point at the same speed, and producing an external electric field between a pair of electrodes at the virtual contact point to ionize the space between the intermediate and insulating surfaces; and developing the transferred charge image with toner.

The present invention is further generally characterized in apparatus for electrostatic reproduction of originals including means defining a first electrode for moving an intermediate surface along a first predetermined path; means for forming a latent charge image corresponding to an original to be reproduced on the intermediate surface; a sheet of material having an insulating surface; means defining a second electrode for moving the sheet of material along a second predetermined path converging with the first path to bring the insulating and intermediate surfaces to a point of virtual contact at the same speed; voltage means for establishing a difference of potential between the first and second electrodes to transfer the charge image from the intermediate surface to the insulating surface at the point of virtual contact; and developing means disposed downstream of the point of virtual contact for developing the transferred charge image on the insulating surface with toner.

Some of the advantages of the present invention over the prior art are that the method and apparatus of the present invention utilize charge transfer while providing reliable, high quality reproduction, high quality, half-tone images with continuous gradation can be transferred from the photoconductive layer, and high quality color reproductions can be produced by superposing three successive images of an original in color, utilizing selective filters and toners for developing the transferred images of appropriate color for each image.

Other objects and advantages of the present invention will become apparent from the following description of the preferred embodiment taken in conjunction with the accompanying drawings.

DESCRIPTION OF THE PREFERRED EMBODIMENT

Figure 1:
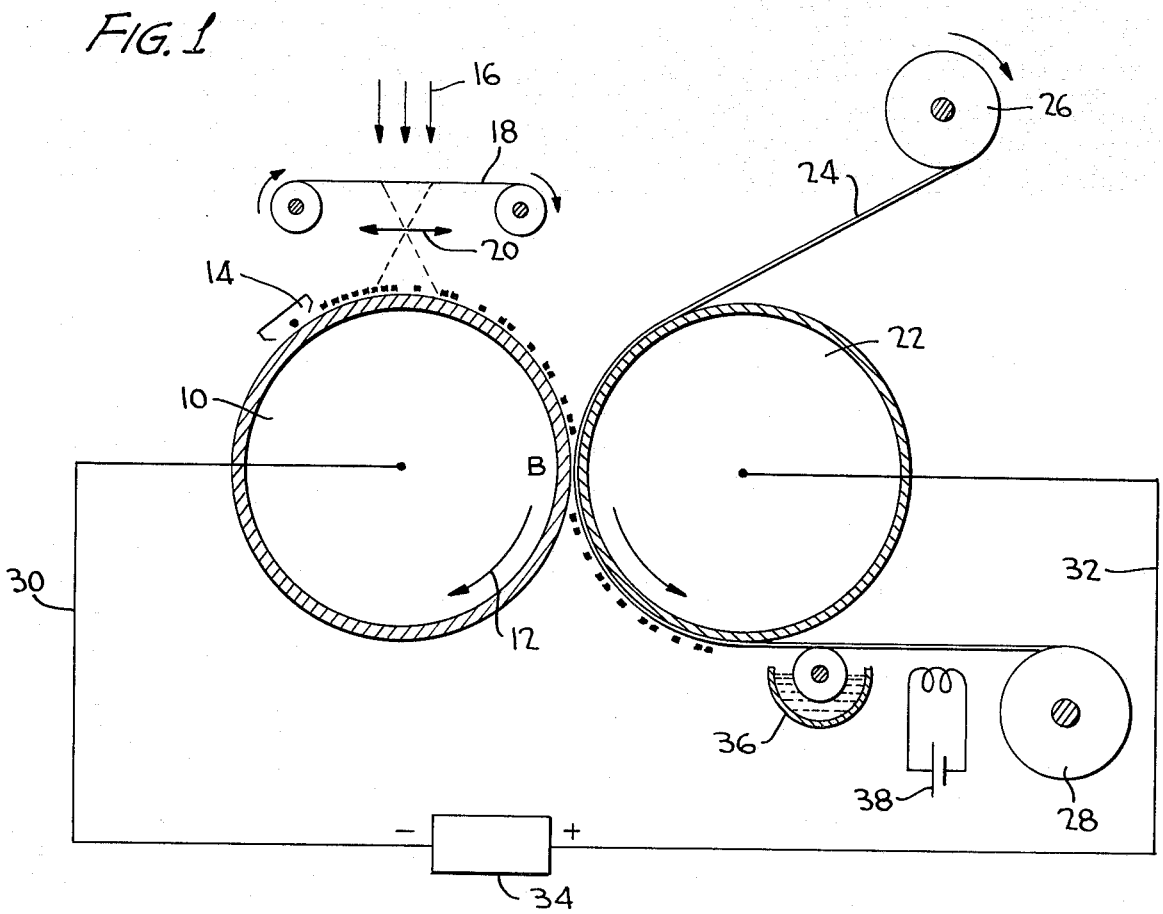
FIG. 1 is a diagrammatic representation of apparatus for implementing the method according to the present invention.

Apparatus for implementing the method of the present invention is illustrated in FIG. 1; however, while the apparatus of FIG. 1 is preferred in accordance with the present invention, the method of the present invention can be implemented with any suitable or equivalent apparatus. A cylindrical drum 10 formed of conductive material is driven in the direction of the arrow 12 by a motor or any other suitable means, not shown; and the drum 10 carries on its periphery a photoconductive surface. The photoconductive surface is uniformly charged by a Corona charging unit 14 such that the charged photoconductive surface can be selectively discharged in accordance with light 16 passed through an original 18 and an optical system generally indicated at 20. As is well known, due to the photoconductive nature of the surface, a latent charge image will be formed on the photoconductive surface corresponding to those areas not receiving light through the optical system and, as the drum 12 is rotated, the latent charge image will be moved into virtual contact at a tangential position B with a cylindrical drum 22 formed of conductive material driven at the same peripheral speed as drum 10, preferably by the same means. A web of paper 24 is delivered from a supply reel 26 to a take-up reel 28 and passes over the drum 22 such that the paper is driven at the peripheral speed of the drum. The surface of the paper 24 opposite the surface in contact with the drum 22 is coated with an insulating layer. Drums 10 and 22 are connected via leads 30 and 32 to opposite polarity terminals of a DC source of electricity 34 whose power can be adjusted. The drums 10 and 22, thus, constitute electrodes for setting up an external electric field with the direct voltage supplied by source 34, such external electric field being strongest at the tangentail point B to aid in the latent charge image carried by the photoconductive surface of drum 10 being transferred to the insulating surface of the dielectric paper 24 carried by drum 22. The charge image transferred to paper 24 is developed by application of toner at a developing station 36 and the toner developed image is fixed by a heating device 38.

Figure 2:
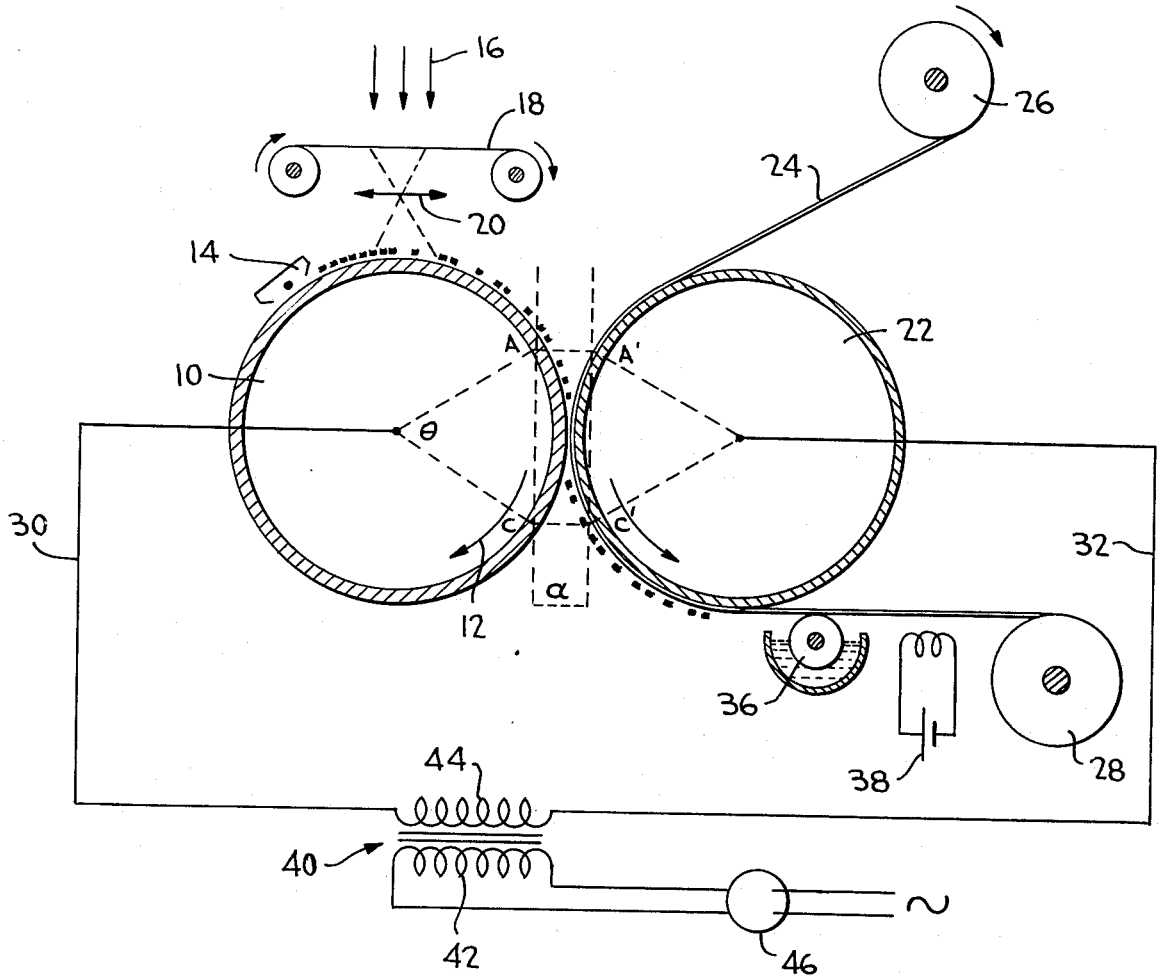
FIG. 2 is a diagrammatic representation of a modification of the apparatus of FIG. 1.

A modification of the apparatus of FIG. 1 is illustrated in FIG. 2 with identical parts being given identical reference numbers and not described again. The primary difference between the apparatus of FIGS. 1 and 2 is that the direct current source 34 in FIG. 1 has been replaced by a source of alternating current generally indicated at 40. The source 40 includes a step-up transformer having a primary winding 42 and a second winding 44 having its end terminals connected to drums 10 and 22 through leads 30 and 32, respectively. The transformer is preferably adjustable in such a manner as to permit effective control of the amplitude or intensity of the electric field to be created. The distance *d* in FIG. 3 represents the critical distance below which charges from drum 10 can be transferred onto the paper 24, the distance d intersecting the periphery of the drums 10 and 22 to define arcs AC and A'C' having lengths 1 subtended by an angle $\theta$.

Figure 3:
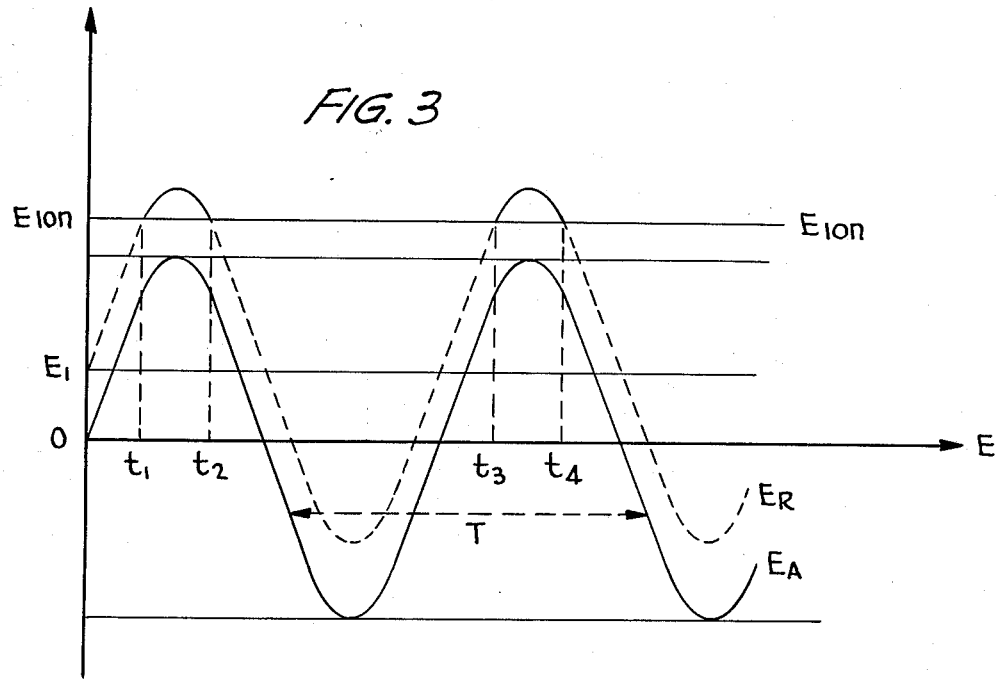
FIG. 3 is a plot of an external field curve for the apparatus of FIG. 2 with time plotted along the abscissa and voltage plotted along the ordinant.

The charge carried at any point on the intermediate insulative photoelectric or dielectric surface of the drum 10 is transferred onto the dielectric paper 24 at the moment that the point, which describes arc AC at a speed V during an interval *t*, is in the crest or maximum zone of the external field, which zone is illustrated in FIG. 3 as the solid line portions of curve $E_r$.

With reference to FIG. 3, the field created by the charge image is represented as $E_1$ and the auxiliary field corresponding to the voltage across the secondary winding 44 of source 40 is represented by curve $E_A$ while the ionizing voltage is represented at $E_{ion}$. The resultant external electric field $E_r$, thus, is equal to the charge image field $E_1$ plus the auxiliary field $E_A$created between the electrodes formed by drums 10 and 22 and the portions of the curve $E_r$ equal to or greater than the ionization voltage Eion are shown in solid lines in FIG. 3.

When the auxiliary field $E_A$ has a sinusoidal characteristic and varies periodically and symmetrically in time, the portions of the curve $E_r$ extend above the ionization voltage $E_{ion}$ only during a fraction of the time. To a given point of the charge image producing the charge $E_1$, there will correspond a resultant alternating field of the same sinusoidal form of that of auxiliary field $E_A$ applied to the drums 10 and 22 but shifted by the voltage $E_1$. The image field $E_1$ is, thus, added to the auxiliary field $E_A$ to produce the resultant field $E_r$, which is shown in dashed lines, and only exceeds the ionization field $E_{ion}$ in the zones or portions shown in solid lines; and, accordingly, charge transfer will only occur during the periods of time between $t_1$ and $t_2$ and $t_3$ and $t_4$.

Each point forming the charge image on the intermediate surface of drum 10 will reliably be subject to an ionizing portion of the resultant field $E_r$ once during any movement through the arc AC at speed V in that, in accordance with the present invention, the speed V is such that the period T of the alternating auxiliarly field $E_A$ is less than *t*. That is, for each cycle of the auxiliarly field $E_A$ and, therefore, of the resultant field $E_r$, the resultant field $E_r$ will be above the ionization level $E_{ion}$ during a single period of time and, thus, since the time *t* of passage from A to C along drum 10 is greater than period T, each point of the charge image will be subject to a resultant field above the ionization level during its passage through the ionization zone. By utilizing a frequency generator 46 connected between the commercially available source of alternating current and the transformer of source 40, the frequency of the auxiliary field $E_A$ can be adjusted to operative conditions which may vary as a function of numerous factors among others including the terminal voltage of the transformer, the diameter of the arcs AC and A'C' for the charge potential of the image carried on the photoconductive surface of the drum 10 which depends upon the nature of the photoconductor and directly influences the critical ionization distance *d*.

As an example, if a photoconductor is used having a critical ionization distance *d* which defines an arc having a length 1 equal to 2 mm. or 0.2 cm. and if the frequency of the alternating current producing the auxiliary field $E_A$ is 50 cycles, the linear peripheral speed V of the drums 10 and 22 in accordance with the present invention must satisfy the inequality $$l/V \geq 1/N \text{ or } V \leq l \cdot N$$

that is, $V \leq 0.2 \times 50 = 10$ cm/sec.

Accordingly, the apparatus of FIG. 2 using commercially available alternating current can insure the transfer of 20 standard A4 formats per minute, such speed being adequately within practical requirements and, further, can be readily increased.

In both of the embodiments of FIGS. 1 and 2, as the intermediate surface carrying the latent charge image and the insulating surface on the sheet of material 24 approach or converge each other, the external field to which the surfaces are exposed will increase in that the intensity of the external field varies inversely in proportion to the distance between the electrodes and, therefore, the surfaces; and, accordingly, when corresponding points on the intermediate and insulating surfaces are sufficiently close, the external field will be high enough to produce ionization in the space therebetween. As the two surfaces move apart or diverge, the intensity of the external field decreases until it ceases to have an effect on the portion of the insulation surface onto which the charge image has been transferred, the effect of the field being further decreased in that the transferred charge produces an inverse field opposite to the external field. Accordingly, the ionization zone at the point of immediate tangential proximity is well localized or limited and the transfer of the charge image is effected virtually line-by-line or point-by-point.

Once the latent charge image has been transferred to the insulating surface of the sheet of material 24, the transferred image is moved to developing station 36 where it is developed by means of liquid or powder toner and, thereafter, the developed image is fixed by heating unit 38. The transferred charge image may be developed in any conventional manner in accordance with known xerograph and electrophotography techniques and, in order to obtain quality reproductions, especially with respect to half tones accentuating the quality of the latent images that the method and apparatus of the present invention permit due to the good definition of the transferred image, it is preferable to utilize a developer system that eliminates margin effects.

To ensure that the latent charge image on the intermediate surface is transferred to the insulating surface, the external field developed between the two electrodes defined by the electrically conductive drums 10 and 22 must be properly oriented. Accordingly, if the charge image to be transferred is formed of positive charges, the lead 30 connected with drum 10 should be connected to the positive terminal of the voltage source 34 and the lead 32 from the drum 22 should be connected to the negative terminal of the source 34. The method of the present invention, therefore, permits positive reproductions of a positive original and negative reproductions of a negative original.

The method and apparatus, according to the embodiment of FIG. 1, utilize a continuous external field from a source of direct current with the voltage being between 100 and 6,000 volts and excellent results being obtained for the transfer of standard photoconductive images with voltages ranging between 200 and 1,000 volts supplied by any conventional means, such as a battery, rectifier, generator or the like. While the apparatus and method of the embodiment of FIG. 1 provide excellent results, such have the limitations that the use of a source of direct current requires a rectifier and supplementary apparatus in order to provide a variable voltage. Furthermore, the apparatus cannot be utilized other than with charges of a specific polaritly such that the apparatus is not sufficiently flexible for use where it is desired to deposit charges of either polarity depending upon the nature of the original and the nature of the reproduction desired therefrom. Such flexibility is particularly important when the originals to be reproduced are in the form of microfilm documents to be reproduced on paper in that the microfilm original may be a negative as well as a positive while it is desired to reproduce positive copies. The control of the reversal reproduction can be implemented when utilizing a photoconductive material that can accept either positive or negative charges; however, in order to obtain such reversal reproduction, it is necessary to reverse the external field during each reproduction cycle.

As discussed above, charge image transfer is effected when the intermediate and insulating surfaces are moved into virtual contact, such virtual contact being at the point B of immediate tangential proximity illustrated in FIGS. 1 and 2. In practice, the distance separating the intermediate and insulating surfaces at the point of virtual contact will minimally be between 0 and 100 microns; however, it is preferable that the separation distance not exceed 100 microns in order to avoid deterioration of image quality and loss of definition in that image quality is increased in proportion to decrease of the distance between the intermediate and insulating surfaces.

The amplitude or intensity of the external field created to effect the transfer of the charge image, as discussed above, must be sufficient to insure ionization in the zone of virtual contact of the intermediate and insulating surfaces while being maintained as close as possible to the potential required for ionization. The ionization potential in the zone of virtual contact is dependent, among others, upon the level of the charge of the image to be transferred, the nature of the intermediate and insulating surfaces, the distance separating the intermediate and insulating surfaces at the point of virtual contact and, in general, upon operating conditions; and, accordingly, the ionization potential cannot be determined with precision a priori. Thus, in practice, the external field is adjusted under actual working conditions prior to continuous operation of the apparatus.

The surface bearing the charge image to be transferred is of an insulating nature and may be formed by any suitable material to provide dielectric, photoconductive or the like characteristics. Thus, the intermediate surface has the requirement only of having the capability of retaining a configuration of electrostatic charges deposited thereon. The configuration of the charge image may be produced by any conventional means, such as electron beam scanning, the use of a stylus of a specific potential, the use of a cone formed of conductive wires at a desired potential, the use of a photoconductive grid or any other conventional means. For convenience, photoconductive surfaces similar to those currently used in xerography can be used, such photoconductive surfaces being constituted by an electrically conductive support, such as paper, a metallic sheet, and a complex or any other suitable support containing a conventional photoconductive layer formed of a photoconductor associated with a binder. The charge image can be formed on the photoconductive surface in accordance with convention xerographic methods and, when the charge image to be transferred has been formed on a photoconductive surface in accordance with standard procedures, the transfer of the charge image must be performed in the dark. Additionally, the image to be transferred can be formed by metallic relief at a specific potential.

The charge receiving surface may take the form of any insulating surface capable of storing a charge for a length of time sufficient for developing. The charge receiving surface can, accordingly, be formed of a plastic film, polyethylene, polypropylene, polyester, etc., or by a sufficiently insulative paper. Further, the charge receiving surface could be formed of a sheet coated with a polymer base dielectric coating, e.g. polystyrene, polyvinyl acetochlorides, cellulose acetate, silicones, or the like, possibly with insulating pigments, such as titanium oxide, zine sulfide, zinc oxide or the like. The charge receiving surface can also be constructed of a sheet of paper that is temporarily insulating, for example by thorough drying of a sheet of ordinary paper thereby obviating any requirement for the preparation of a special insulating surface for use with the method and apparatus of the present invention. In utilizing ordinary paper thoroughly dried, the resistivity of the paper must be high at the amount of the charge transfer and must be retained at an insulatively high level until after developing; however, the insulating nature of the paper may be reduced after the developed toner image is fixed to the paper. It is not necessary that the charge receiving surface be bonded to a conductive surface and, accordingly, the method and apparatus of the present invention can be utilized to make recto-verso copies without difficulty.

Inasmuch as the present invention is subject to many variations, modifications and changes in detail, it is intended that all matter described above or shown in the accompanying drawings be interpreted as illustrative and not in a limiting sense.

What is claimed is:

1. A method for electrostatic reproduction of an original image on an initially uncharged insulating surface comprising the steps of:

forming a preliminary charge image having a predetermined field intensity corresponding to an original image, said preliminary charge image being formed on an intermediate photoconductive surface;

advancing the intermediate photoconductive surface, at a predetermined speed, with the charge image thereon toward a point of virtual contact with the insulating surface, while advancing the insulating uncharged surface, at a predetermined speed;

transferring the charge image progressively, line by line and instantaneously from the photoconductive surface to the insulating surface to charge the insulating surface in a pattern in correspondence with said image;

advancing said photoconductive surface away from said insulating surface after transferring said image; and developing the transferred charge image;

wherein said transferring step includes the steps of:

producing an external electric field between a pair of electrodes, at the virtual contact point, to ionize the air in the space therebetween; and varying the electric field periodically and symmetrically, with a low frequency alternating current, wherein the frequency is coordinated with the speed of advance of the photoconductive and insulating surfaces, so that the intensity of the field produced by the alternating current, plus the intensity of field produced by the charge image exceeds the ionization potential at the point of virtual contact to thereby transfer the charge image.

2. The method of claim 1, wherein the photoconductive surface and insulating surface are advanced at the same linear speed.

3. The method of claim 1, wherein the alternating current has a frequency substantially equivalent to commercially available alternating current.

* * * * *